US009988804B2

(12) United States Patent
Lin

(10) Patent No.: US 9,988,804 B2
(45) Date of Patent: Jun. 5, 2018

(54) FLOOR DRAIN FOR SAME FLOOR DRAINAGE WITHOUT DESCENDING FLOOR OF BUILDING

(71) Applicant: KUNMING QUNZHIYING TECHNOLOGY CO., LTD, Kunming (CN)

(72) Inventor: Guoqiang Lin, Kunming (CN)

( * ) Notice: Subject to any disclaimer, the term of this patent is extended or adjusted under 35 U.S.C. 154(b) by 0 days. days.

(21) Appl. No.: 15/719,560

(22) Filed: Sep. 29, 2017

(65) Prior Publication Data

US 2018/0023279 A1 Jan. 25, 2018

Related U.S. Application Data

(63) Continuation of application No. PCT/CN2016/080461, filed on Apr. 28, 2016.

(30) Foreign Application Priority Data

May 22, 2015 (CN) ..... 2015 1 0265273

(51) Int. Cl.
*E03F 5/04* (2006.01)
*E03F 5/06* (2006.01)

(52) U.S. Cl.
CPC ..... *E03F 5/0407* (2013.01); *E03F 5/06* (2013.01); *E03F 5/04* (2013.01); *E03F 5/0408* (2013.01);
(Continued)

(58) Field of Classification Search
CPC . E03F 5/0407; E03F 5/06; E03F 5/408; E03F 5/409; E03F 5/04; E03F 2005/0416
(Continued)

(56) References Cited

U.S. PATENT DOCUMENTS 1,648,701 A * 11/1927 Smallbrook ..... E03F 5/0408 210/165
2,400,070 A * 5/1946 Boosey ..... E03C 1/26 210/165

(Continued)

FOREIGN PATENT DOCUMENTS

CN 2789323 Y 6/2006
CN 202347645 U 7/2012

(Continued)

OTHER PUBLICATIONS

NPL #1—English translation of KR 1020130018624 as obtained from KIPO.*

*Primary Examiner* — John K Fristoe, Jr.
*Assistant Examiner* — Josephine Trinidad-Borges
(74) *Attorney, Agent, or Firm* — Wayne & Ken, LLC; Tony Hom

(57) ABSTRACT

A floor drain for same floor drainage of a building consists of a floor drain body and a floor drain cover The floor drain body consists of a lower accumulated water collection tank, a lateral accumulated water collection tank and an accumulated water discharge port. A bottom of the lower accumulated water collection tank is sealed, and has an angle of 70° to 120° with the lateral accumulated water collection tank. The floor drain cover is a plate with holes, and is divided into a lower upstream face and a lateral upstream face. The lower upstream face of the floor drain cover is located above the lower accumulated water collection tank, and the lateral upstream face of the floor drain cover is located outside the lateral accumulated water collection tank.

15 Claims, 7 Drawing Sheets

(52) U.S. Cl.
CPC ..... *E03F 5/0409* (2013.01); *E03F 2005/0416* (2013.01)

(58) Field of Classification Search
USPC ..... 137/312, 313, 362
See application file for complete search history.

(56) References Cited

U.S. PATENT DOCUMENTS

| | | | | | |
|---|---|---|---|---|---|
| 3,881,832 | A * | 5/1975 | Maguire | E03F 5/06 | 210/164 |
| 4,040,447 | A * | 8/1977 | Scott | C23F 13/02 | 138/103 |
| 5,571,407 | A * | 11/1996 | Kato | E04D 13/0431 | 210/164 |
| 5,954,952 | A * | 9/1999 | Strawser, Sr. | B01D 29/01 | 210/164 |
| 7,278,613 | B2 * | 10/2007 | Roy | F16L 3/02 | 138/106 |
| 2006/0231509 | A1 | 10/2006 | Marzett | | |
| 2007/0122237 | A1 * | 5/2007 | Blaschke | E03F 5/06 | 405/127 |

FOREIGN PATENT DOCUMENTS

| | | | | |
|---|---|---|---|---|
| CN | 102839724 | A | 12/2012 | |
| CN | 103643725 | A | 3/2014 | |
| CN | 204174705 | U | 2/2015 | |
| CN | 104863245 | A | 8/2015 | |
| CN | 204703282 | U | 10/2015 | |
| DE | 2521794 | A1 * | 11/1976 | E03F 5/0408 |
| DE | 19836930 | A1 * | 2/2000 | E03F 5/0407 |
| JP | 2004124669 | A | 4/2004 | |
| JP | 2008075430 | A | 4/2008 | |
| KR | 20050047181 | A | 5/2005 | |
| KR | 20110058613 | A | 6/2011 | |
| KR | 20130018624 | A * | 2/2013 | E03F 5/0407 |

* cited by examiner

FLOOR DRAIN FOR SAME FLOOR DRAINAGE WITHOUT DESCENDING FLOOR OF BUILDING

TECHNICAL FIELD

The present invention relates to a floor drain for same floor drainage, and more specifically, to a floor drain for same floor drainage without descending floor of a building.

BACKGROUND

Currently, if same floor drainage needs to be realized in a building toilet, a floor of the toilet is required to be descended entirely or locally. To reduce the height of descending the floor, the width of a flow path of a floor drain and an area of a drainage section are also reduced, thereby easily causing blockage or impeded drainage of the floor drain and a drainage pipeline.

SUMMARY

The purpose of the present invention is to overcome existing technical defects, so as to provide a floor drain for same floor drainage used in the same floor drainage without descending floor of a building, thereby improving the unobstruction and difficult blocking of the drainage, being easy to maintain, and improving human life and sanitary environments.

A floor drain for same floor drainage without descending floor of a building in the present invention comprises a floor drain body and a floor drain cover. The floor drain cover and the floor drain body are separable. The floor drain body comprises a lower accumulated water collection tank, a lateral accumulated water collection tank and an accumulated water discharge port. A bottom of the lower accumulated water collection tank is closed, and the lower accumulated water collection tank has an angle of 70° to 120° with the lateral accumulated water collection tank. The accumulated water discharge port is located at the rear of the lateral accumulated water collection tank. The floor drain cover is a plate with holes, and is divided into a lower upstream face and a lateral upstream face. An angle between the lower upstream face and the lateral upstream face is 70° to 120°. The lower upstream face of the floor drain cover is located above the lower accumulated water collection tank. The lateral upstream face of the floor drain cover is located outside the lateral accumulated water collection tank. The floor drain can drain surface water from the lower upstream face and the lateral upstream face simultaneously, thereby increasing the area of a water inlet section and accelerating the drainage of the surface water.

According to the floor drain for same floor drainage without descending floor of the building in the present invention, an inner wall of the bottom of the lower accumulated water collection tank of the floor drain body is higher than or level with an inner wall of a bottom of the accumulated water discharge port, so that when surface water enters the accumulated water discharge port, a certain level difference can be formed, and the surface water can directly flow into a drainage concentrator having a water sealing function and a maintenance function without passing through a water seal, thereby greatly improving the unobstruction of drainage. An area of a drainage section of the accumulated water discharge port level with a horizontal section of a top surface of the lower accumulated water collection tank of the floor drain body is greater than or equal to 450 $mm^2$ and less than 3500 $mm^2$, thereby guaranteeing that the floor drain has relatively large drainage discharge.

According to the floor drain for same floor drainage without descending floor of the building in the present invention, a support protruding from an outer wall is arranged at the bottom of the lower accumulated water collection tank, and when the accumulated water discharge port is horizontal, a bottom of the support is above 5 mm lower than a bottom of the accumulated water discharge port, thereby guaranteeing that a certain slope is formed by the accumulated water discharge port and a pipeline connecting the accumulated water discharge port so that accumulated water is not retained in the pipeline, and guaranteeing that a water flow has a certain speed. A distance from the bottom of the support to a top surface of the lower upstream face of the floor drain cover is greater than 10 mm and less than 70 mm, so that the floor drain for same floor drainage can be directly embedded in a cushion, a leveling layer and a decorative layer of the building, thereby achieving a using effect of not descending the floor.

According to the floor drain for same floor drainage without descending floor of the building in the present invention, a distance from the closed bottom of the lower accumulated water collection tank of the floor drain body to a top surface of the lower attaining surface of the floor drain cover is greater than 10 mm and less than 60 mm, and thus, the area of a flowing section of the accumulated water discharge port can be increased on the premise of applying to a condition of not descending the floor.

According to the floor drain for same floor drainage without descending floor of the building in the present invention, when the inner wall of the closed bottom of the lower accumulated water collection tank centers on the accumulated water discharge port, a middle is lower and two sides are higher, so that a water flow having certain kinetic energy can be rapidly formed when only a little quantity of accumulated water enters the lower accumulated water collection tank on the ground, so that the lower accumulated water collection tank is not deposited, thereby improving a drainage effect.

According to the floor drain for same floor drainage without descending floor of the building in the present invention, more than one slot is arranged on the lower accumulated water collection tank; more than one clamping groove is arranged on the lateral accumulated water collection tank; more than one convex point corresponding to the slot is formed on the lower attaining surface of the floor drain cover; or more than one slot is arranged on the lateral accumulated water collection tank; more than one clamping groove is arranged on the lower accumulated water collection tank; and a convex point corresponding to the slot is formed on the lateral attaining surface of the floor drain cover. Therefore, when the convex point is inserted into the slot, the floor drain cover can be fixed to the floor drain body or separated from the floor drain body for blockage removal and maintenance by applying a certain force to the floor drain cover in a position of the clamping groove.

According to floor drain for same floor drainage without descending floor of the building in the present invention, a plane greater than 50 mm is formed at the bottom of the support, and when the floor drain for same floor drainage is installed, the floor drain for same floor drainage placed on the ground can be guaranteed not to fall toward one side when the lower accumulated water collection tank has a lower middle and two higher sides.

DETAILED DESCRIPTION

The present invention is further described below in combination with drawings, but is not limited to embodiments.

Embodiment 1

Figure 1:
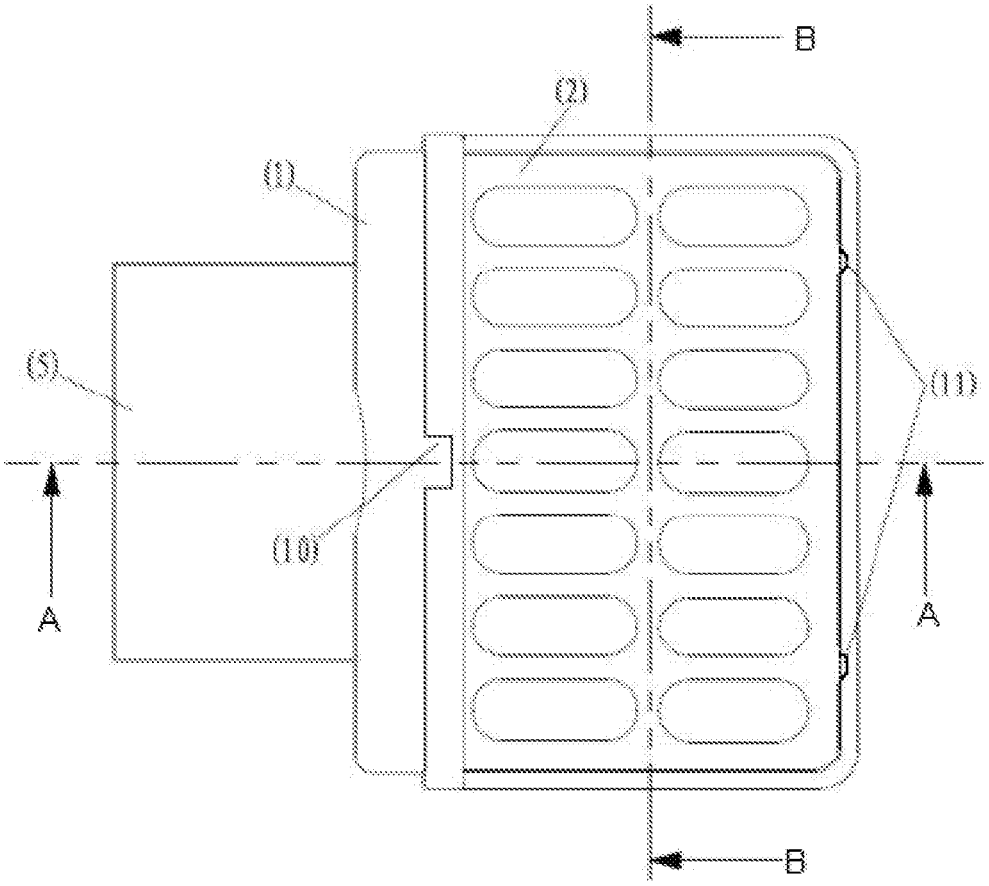
FIG. 1 is a top view of the present invention.
Figure 2:
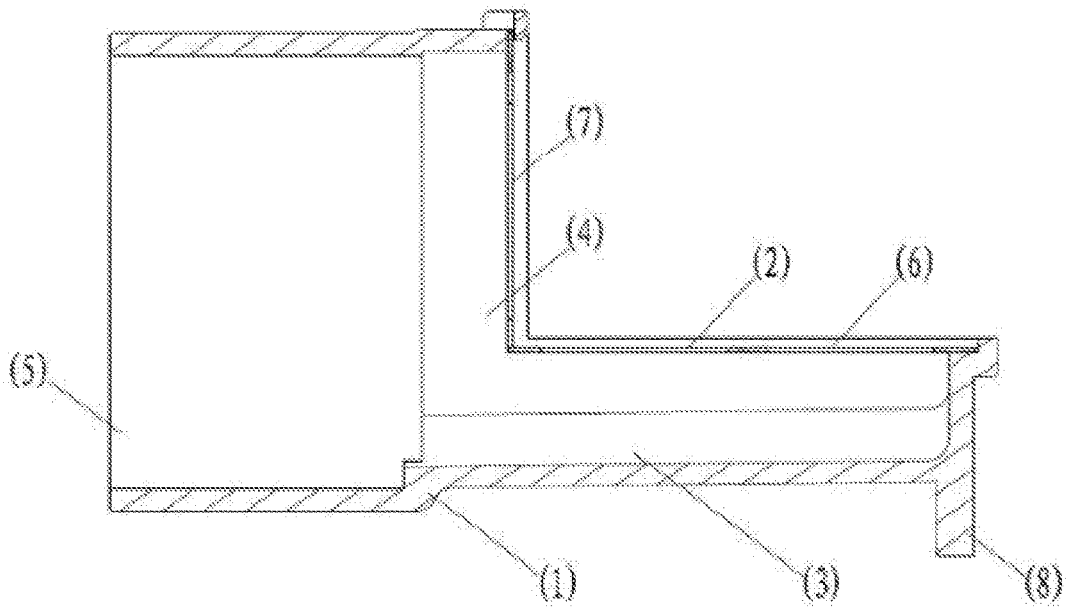
FIG. 2 is a sectional view of a section A-A of FIG. 1.
Figure 7:
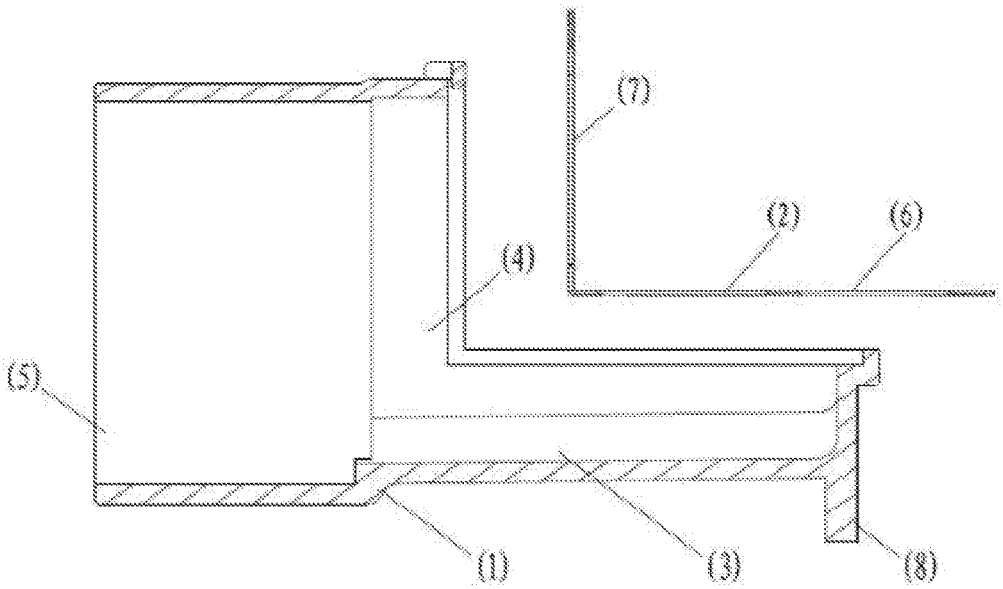
FIG. 7 is a diagram of separation of a floor drain body and a floor drain cover of the present invention.

As shown in FIGS. 1, 2 and 7, a floor drain for same floor drainage without descending floor of a building in the present invention consists of a floor drain body 1 and a floor drain cover 2. The floor drain body 1 and the floor drain cover 2 are separable. The floor drain body 1 consists of a lower accumulated water collection tank 3, a lateral accumulated water collection tank 4 and an accumulated water discharge port 5. A bottom of the lower accumulated water collection tank 3 is closed, and the lower accumulated water collection tank 3 has an angle of 90° with the lateral accumulated water collection tank 4. The accumulated water discharge port 5 is located at the rear of the lateral accumulated water collection tank 4. The floor drain cover 2 is a plate with holes, and is divided into a lower upstream face 6 and a lateral upstream face 7. An angle between the lower upstream face 6 and the lateral upstream face 7 is 90°. The lower upstream face 6 of the floor drain cover 2 is located above the lower accumulated water collection tank 3 of the floor drain body 1. The lateral upstream face 7 of the floor drain cover 2 is located outside the lateral accumulated water collection tank 4 of the floor drain body 1.

Embodiment 2

Figure 5:
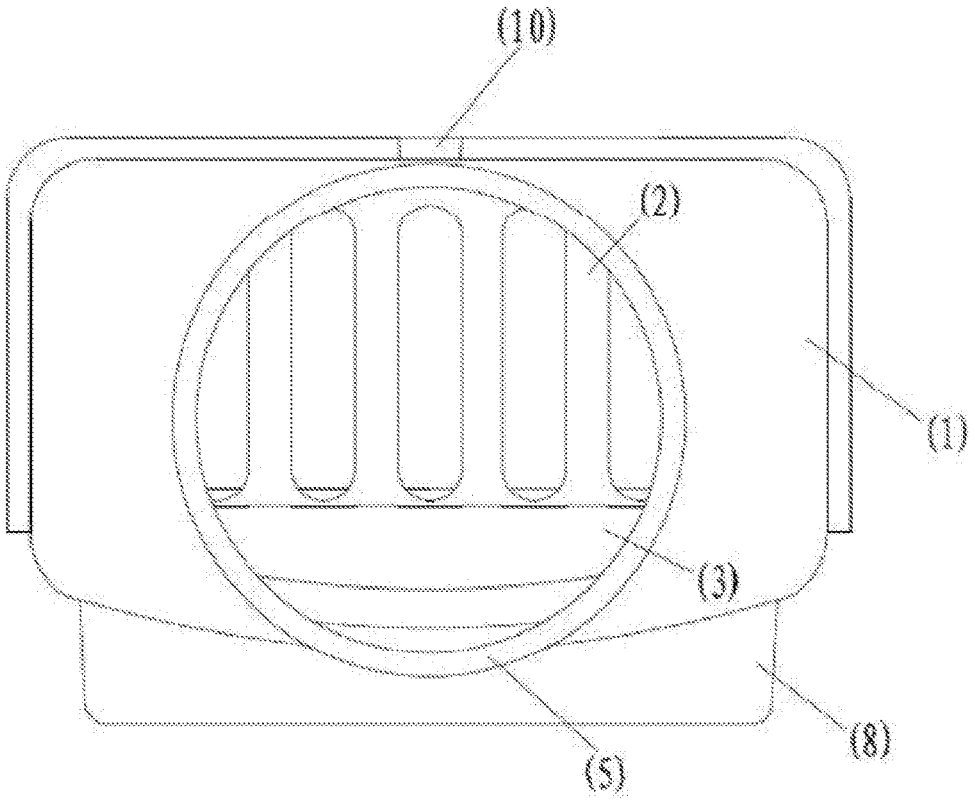
FIG. 5 is a rear view of FIG. 1.

As shown in FIGS. 2 and 5, an inner wall of the bottom of the lower accumulated water collection tank 3 of the floor drain body 1 of the floor drain for same floor drainage without descending floor of the building in the present invention is higher than or level with an inner wall of a bottom of the accumulated water discharge port 5. An area of a drainage section of the accumulated water discharge port 5 level with a horizontal section of a top surface of the lower accumulated water collection tank of the floor drain body 1 is greater than or equal to 450 $mm^2$ and less than 3500 $mm^2$, preferably 1080 $mm^2$. Others are the same as those of Embodiment 1.

Embodiment 3

Figure 3:
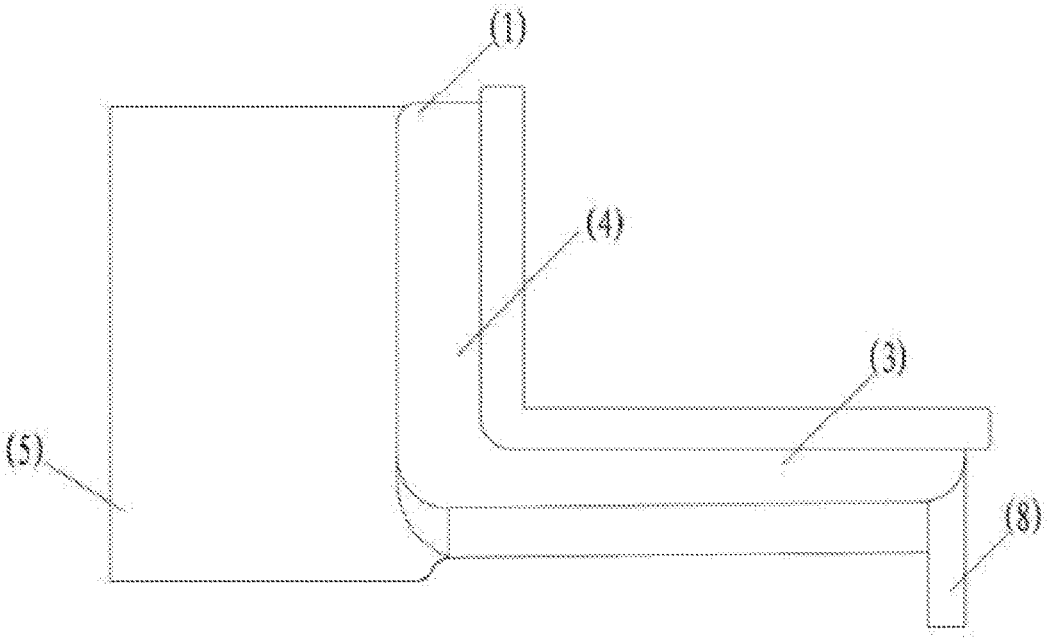
FIG. 3 is a side view of FIG. 1.
Figure 4:
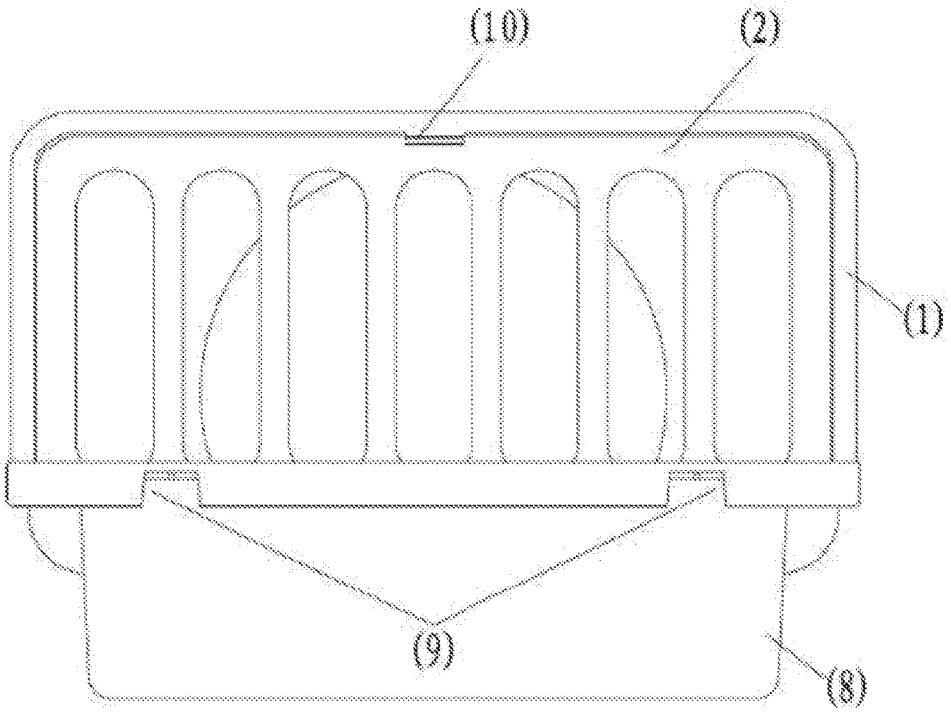
FIG. 4 is a front view of FIG. 1.

As shown in FIGS. 2, 3 and 4, a distance from the inner wall of the closed bottom of the lower accumulated water collection tank 3 of the floor drain body 1 of the floor drain for same floor drainage without descending floor of the building in the present invention to the lower attaining surface of the floor drain cover 2 is 20 mm. A support 8 protruding from an outer wall is arranged at the bottom of the lower accumulated water collection tank 3, and when the accumulated water discharge port 5 is horizontal, a bottom of the support 8 is 8 mm lower than a bottom of the accumulated water discharge port 5, and a distance from the bottom of the support 8 to a top surface of the lower upstream face of the floor drain cover 2 is 35 mm. Others are the same as those of Embodiment 2.

Embodiment 4

Figure 6:
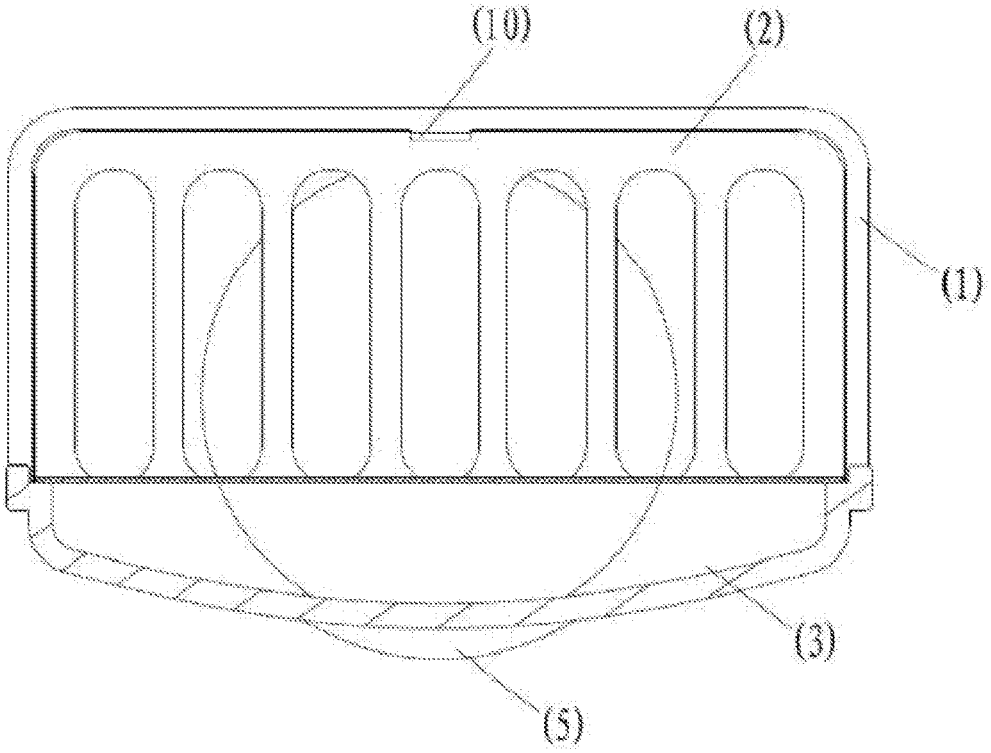
FIG. 6 is a sectional view of a section B-B of FIG. 1.

As shown in FIGS. 5 and 6, when the inner wall of the closed bottom of the lower accumulated water collection tank 3 of the floor drain for same floor drainage without descending floor of the building in the present invention centers on the accumulated water discharge port 5, a middle is lower and two sides are higher. Others are the same as those of Embodiment 3.

Embodiment 5

As shown in FIGS. 1 and 4, two slots 9 are formed on the lower accumulated water collection tank 3 of the floor drain for same floor drainage without descending floor of the building in the present invention. One clamping groove 10 is formed in a lateral accumulated water collection tank 4. Two convex points 11 corresponding to the slot 9 are formed on the lower upstream face 6 of the floor drain cover. Others are the same as those of Embodiment 4.

Embodiment 6

As shown in FIGS. 2, 3, 4 and 5, the bottom of the support 8 of the floor drain for same floor drainage without descending floor of the building in the present invention is a rectangular plane, and a long side is 90 mm.

The above only describes preferred embodiments of the present invention, and is only used for describing the technical solution of the present invention, rather than liming the present invention. Although the present invention is described in detail by referring to better embodiments, those ordinary skilled in the art should understand that any amendment, equivalent replacement, improvement and the like made within spirits and principles of the present invention should be included in a protection scope of the present invention.

What is claimed is:

1. A floor drain, consisting of a floor drain body (1) and a floor drain cover (2), wherein the floor drain cover (2) and the floor drain body (1) are separable; the floor drain body (1) consists of a lower accumulated water collection tank (3), a lateral accumulated water collection tank (4) and an accumulated water discharge port (5); a bottom of the lower accumulated water collection tank (3) is closed, and the lower accumulated water collection tank (3) has an angle of 70° to 120° with respect to the lateral accumulated water collection tank (4); the accumulated water discharge port (5) is located at a rear of the lateral accumulated water collection tank (4); the floor drain cover (2) is a plate with holes, and is divided into a lower upstream face (6) and a lateral upstream face (7); an angle between the lower upstream face (6) and the lateral upstream face (7) is 70° to 120°; the lower upstream face (6) of the floor drain cover (2) is located above the lower accumulated water collection tank (3); and the lateral upstream face (7) of the floor drain cover (2) is located outside the lateral accumulated water collection tank (4); a support (8) is arranged at the bottom of the lower accumulated water collection tank (3) protruding from an outer wall of the lower accumulated water collection tank (3), and when the accumulated water discharge port (5) is horizontal, a bottom of the support (8) is lower than a bottom of the accumulated water discharge port (5) at a distance greater than 5 mm, allowing a level difference to be formed between the accumulated water discharge port (5) and a pipeline connected to the accumulated water discharge port (5), so that the accumulated water is not retained on the pipeline and is discharged.

2. The floor drain of claim 1, wherein an inner wall of the bottom of the lower accumulated water collection tank (3) of the floor drain body (1) is higher than or level with an inner wall of a bottom of the accumulated water discharge port (5), and an area of a drainage section of the accumulated water discharge port (5) level with a horizontal section of a top surface of the lower accumulated water collection tank (3) of the floor drain body (1) is greater than or equal to 450 $mm^2$ and less than 3500 $mm^2$.

3. The floor drain of claim 2, wherein a distance from the bottom of the support (8) to a top surface of the lower upstream face of the floor drain cover (2) is greater than 10 mm and less than 70 mm.

4. The floor drain of claim 3, wherein a distance from the closed bottom of the lower accumulated water collection tank (3) of the floor drain body (1) to a top surface of the lower upstream face (6) of the floor drain cover (2) is greater than 10 mm and less than 60 mm.

5. The floor drain of claim 4, wherein when the inner wall of the closed bottom of the lower accumulated water collection tank (3) centers on the accumulated water discharge port (5), a middle is lower and two sides are high.

6. The floor drain of claim 1, wherein a plurality of slots (9) are arranged on the lower accumulated water collection tank (3); a plurality of clamping grooves (10) are arranged on the lateral accumulated water collection tank (4); and a plurality of convex points (11) each corresponding to each of the plurality of slots (9) are arranged on the lower upstream face (6) of the floor drain cover.

7. The floor drain of claim 2, wherein a plurality of slots (9) are arranged on the lower accumulated water collection tank (3); a plurality of clamping grooves (10) are arranged on the lateral accumulated water collection tank (4); and a plurality of convex points (11) each corresponding to each of the plurality of slots (9) are arranged on the lower upstream face (6) of the floor drain cover.

8. The floor drain of claim 3, wherein a plurality of slots (9) are arranged on the lower accumulated water collection tank (3); a plurality of clamping grooves (10) are arranged on the lateral accumulated water collection tank (4); and a plurality of convex points (11) each corresponding to each of the plurality of slots (9) are arranged on the lower upstream face (6) of the floor drain cover.

9. The floor drain of claim 4, wherein a plurality of slots (9) are arranged on the lower accumulated water collection tank (3); a plurality of clamping grooves (10) are arranged on the lateral accumulated water collection tank (4); and a plurality of convex points (11) each corresponding to each of the plurality of slots (9) are arranged on the lower upstream face (6) of the floor drain cover.

10. The floor drain of claim 5, wherein a plurality of slots (9) are arranged on the lower accumulated water collection tank (3); a plurality of clamping grooves (10) are arranged on the lateral accumulated water collection tank (4); and a plurality of convex points (11) each corresponding to each of the plurality of slots (9) are arranged on the lower upstream face (6) of the floor drain cover.

11. The floor drain of claim 6, wherein a plane of a rectangular shape is formed at the bottom of the support (8).

12. The floor drain of claim 7, wherein a plane of a rectangular shape is formed at the bottom of the support (8).

13. The floor drain of claim 8, wherein a plane of a rectangular shape is formed at the bottom of the support (8).

14. The floor drain of claim 9, wherein a plane of a rectangular shape is formed at the bottom of the support (8).

15. The floor drain of claim 10, wherein a plane of a rectangular shape is formed at the bottom of the support (8).

* * * * *